US005699758A

United States Patent [19]

Clarke

[11] Patent Number: 5,699,758

[45] Date of Patent: Dec. 23, 1997

[54] METHOD AND APPARATUS FOR MULTIPLE CYCLE INTERNAL COMBUSTION ENGINE OPERATION

[75] Inventor: John M. Clarke, Chillicothe, Ill.

[73] Assignee: Caterpillar Inc., Peoria, Ill.

[21] Appl. No.: 601,897

[22] Filed: Feb. 15, 1996

[51] Int. Cl.[6] ..... F02M 25/06

[52] U.S. Cl. ..... 123/21; 123/64

[58] Field of Search ..... 123/21, 64

[56] References Cited

U.S. PATENT DOCUMENTS

| | | | |
|---|---|---|---|
| 4,237,832 | 12/1980 | Hartig et al. | 123/64 |
| 4,945,870 | 8/1990 | Richeson | 123/90.11 |
| 5,007,382 | 4/1991 | Kawamura | 123/21 |
| 5,036,801 | 8/1991 | Imajou | 123/21 |
| 5,193,492 | 3/1993 | Kawamura | 123/21 |

FOREIGN PATENT DOCUMENTS

| | | |
|---|---|---|
| 62-131919 | 6/1987 | Japan . |
| 2 071 210 | 9/1981 | United Kingdom . |

*Primary Examiner*—Marguerite McMahon
*Attorney, Agent, or Firm*—David L. Polsley

[57] ABSTRACT

A method for operating a reciprocating piston-type internal combustion engine selectively in two-stroke, four-stroke, and six-stroke mode includes: providing transfer valves, transfer passage means between piston cylinders, selectively controlling the actuation and timing of the intake, exhaust and transfer valves, and alternatively operating the intake and exhaust valves for each piston cylinder in overlapping sequence during each crankshaft revolution to provide two-stroke operation, operating the intake and exhaust valves in sequence during each second crankshaft revolution to provide four-stroke operation, operating the intake, exhaust, and transfer valves sequentially to cause a secondary expansion stroke in an adjacent piston cylinder to provide six-stroke operation of the engine.

25 Claims, 2 Drawing Sheets

METHOD AND APPARATUS FOR MULTIPLE CYCLE INTERNAL COMBUSTION ENGINE OPERATION

TECHNICAL FIELD

This invention generally pertains to multiple cylinder engines, and more particularly to multiple cylinder engines having means for selectively operating in 2, 4 or 6 stroke modes of operation according to momentary load and efficiency demands.

BACKGROUND ART

It is common practice to construct reciprocating piston-type internal combustion engines which are optimized to provide their best performance within a certain "envelope" of power, torque, and efficiency at different operating speeds. Typically, an engine is optimized toward one or more of these criteria. For example, an engine which is intended to provide a steady power output at a given operating speed may be optimized to provide its best efficiency at that speed, whereas an engine which must provide a given power output at a variety of operating speeds will be optimized to provide that required power even though efficiency of operation may consequently suffer. Furthermore, additional constraints are often imposed by weight and size limitations inherent in the application for which the engine is being designed.

The two-stroke engine operates by providing one power stroke per revolution. In a typical two-stroke engine, the exhaust valve or port is opened when the expansion stroke is 50 to 60 percent or more complete. After the exhaust valve is opened and combustion gas exhaust is initiated, the intake valve or port is opened. The incoming air or air-fuel mixture aids in scavenging the exhaust gases from the operating chamber, with some loss of the incoming charge through the exhaust valve. The piston continues the expansion stroke and initiates the compression stroke. The intake valve is closed after compression is initiated, with compression continuing until ignition and the subsequent expansion stroke. The two-stroke engine offers several advantages, including greater power output for a given piston displacement and speed, and one power stroke for each revolution of the crankshaft.

Four-stroke engines, on the other hand, provide one stroke for each function. Intake of the air or air-fuel mixture is accomplished by opening the intake valve as the piston is withdrawn to increase the volume of the working chamber. As the crankshaft rotates to force the piston upward, the intake valve is closed, and compression occurs. Ignition then forces expansion causing the piston to withdraw, providing the power stroke and rotating the crankshaft. Exhaust is accomplished by opening the exhaust valve during the following piston stroke, which reduces the volume of the working chamber and forces the exhaust gases through the exhaust valve port. The cycle can then be repeated. The four-stroke design typically provides, among other advantages, a broader range of acceptable speed and power, and better efficiency both mechanically and in fuel economy.

Furthermore, for a given design type, valve timing is generally fixed by the mechanism of the valves themselves, and provides little flexibility or opportunity to vary the opening and closing of the valves. The stroke-type of a typical engine cannot therefore be changed without substantial mechanical changes, if at all, and these changes cannot be accomplished during the operation of the engine. Therefore, the typical engine is designed around that cycle which can best be optimized to function in a given application.

Unfortunately, the typical application has requirements which occasionally vary from the optimum needs for that application, and the typical engine often only marginally meets those varying requirements. For example, in motor vehicle applications, it is desirable for most high-speed operation to attain the best possible efficiency, since the power requirement is relatively low, whereas maximum power is desirable for climbing inclines even at some cost to efficiency, and during lower speed operations, it is desirable to provide both good power and good efficiency. In most cases these needs are balanced by trading off power and efficiency, using a four-stroke engine to provide a balance of good balance and efficiency, larger than needed for high-speed operation and less than desirable for climbing inclines.

Several attempts have been made to address these concerns in the prior art. One method is to simply selectively disable the intake and exhaust valves to one or more selected cylinders when under low load conditions to provide greater fuel efficiency by not employing those cylinders to burn fuel and generate power. A major drawback to this method lies in the fact that a relatively large, heavy engine sufficient to meet maximum load requirements must be used, and that weight is present even if no power is being generated. Another method involves the use of independently controlled valves to operably select the stroke of selected cylinders between two-stroke and four-stroke. While this to some extent addresses the problem, there are additional thermodynamic cycles of operation which provide better efficiency than either the two-stroke or four-stroke can provide. These cycles cannot readily be obtained by this method. Furthermore, it is desirable to obtain additional useable power output from the expansion due to combustion in order to improve efficiency and economy of operation, rather than attempting to improve efficiency by employing an adiabatic, non-working cycle of the piston.

Therefore, it is an object of the present invention to provide an engine which can provide selectively two-stroke, four-stroke, or six-stroke operation.

It is another object of the present invention to provide an engine which may be readily manufactured by techniques and equipment consistent with those used in the manufacture of traditional reciprocating piston-type engines.

It is another object of the present invention to provide such an engine as will selectively provide greater power per unit of piston displacement than the typical four-stroke engine.

It is yet another object of the present invention to provide such an engine as will be relatively inexpensive to manufacture.

It is yet another object of the present invention to provide such an engine as will have the requisite durability to meet the requirements of varying suitable applications.

It is yet a further object of the present invention to provide such an engine as will be readily and simply maintained.

It is another object of the present invention to provide such an engine as will have an improved overall cost of operation and improved efficiency.

These and other objectives of the present invention will become apparent in the specification and claims that follow.

SUMMARY OF THE INVENTION

The subject invention is a method and apparatus of operating a reciprocating piston-type internal combustion engine selectively as a two-stroke, a four-stroke, and a six-stroke engine by controlling the timing of the valve operation and by transferring gases between the pistons by way of transfer valves and transfer passage means.

DESCRIPTION OF THE PREFERRED EMBODIMENT

Figure 1:
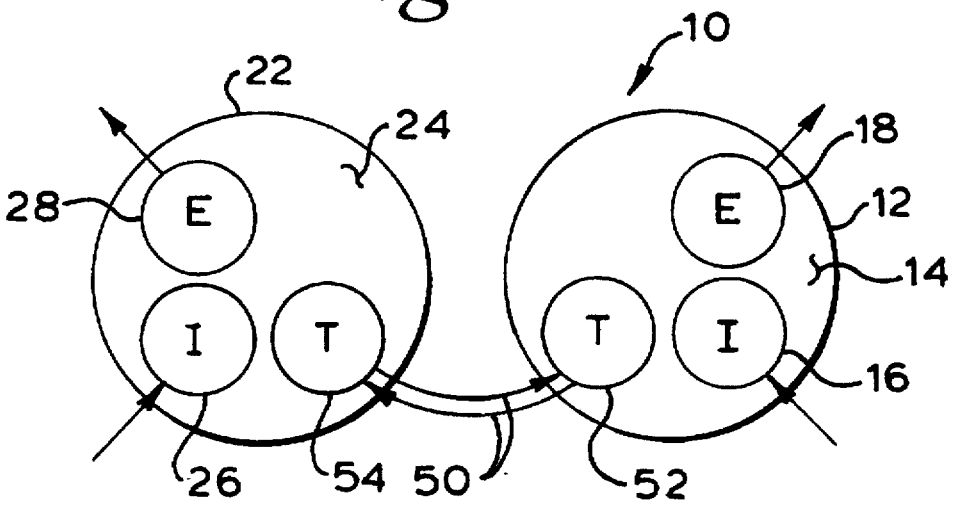
FIG. 1 shows a schematic representation of the valve and passage means configuration in a two cylinder engine according to the present invention.

In FIG. 1 is shown a schematic representation of an apparatus 10 configuration generally according to the present invention is shown in FIG. 1 and referred to with reference number 10. The apparatus 10 is described herein as representing a cylinder head configuration for use in diesel-cycle engines having pistons operating reciprocatingly in cylinders, with the pistons acting to rotate a conventional crankshaft through 360 degree rotations such that useable power is generated. The subject invention should be understood as not limited to that type of engine.

The schematic of FIG. 1 depicts the valve and transfer passage means configuration for an apparatus 10 capable of providing two-stroke, four-stroke, and six-stroke operation as selected according to load and efficiency demands. The apparatus 10 includes a first cylinder 12 in which a first piston 14 operates reciprocally. A first intake valve 16 is provided to permit induction of intake air into the first cylinder 12. A first exhaust valve 18 is provided to permit purging of exhaust gases from the first cylinder 12.

A second cylinder 22 in which a second piston 24 operates reciprocally is provided adjacent the first cylinder 12. A second intake valve 26 is provided to permit induction of intake air into the second cylinder 22, and a second exhaust valve 28 is provided to permit purging of exhaust gases from the second cylinder 22.

Those skilled in the art will understand that the intake valves 16 and 26, and the exhaust valves 18 and 28 refers to those types of valve assemblies typically found in reciprocating piston-type engines, such as poppet valves, electronically controlled valves, or cam- or pushrod-operated valve lifter assemblies. Likewise, any of the various types of cylinder 12 and 22 and piston 14 and 24 assemblies may be employed, such as the traditional I- or V-configuration of piston engine or the Stirling type of piston engine. For clarity of description, no attempt is made to present the various combinations of piston assemblies and valve assemblies to which the subject invention may apply.

According to the preferred embodiment, each respective intake, exhaust, and transfer valve described herein is selectively operable to permit independent operation of each respective cylinder in two-stroke cycle, or in four-stroke cycle, or in the six-stroke cycle.

A transfer passage means 50 communicates between a first transfer valve 52 in the first cylinder 12 and a second transfer valve 54 in the second cylinder 22. The first and second transfer valves 52 and 54 are timed and operated independently of the intake valves 16 and 26 and the exhaust valves 18 and 28.

In two-stroke operation, combustion occurs in the first piston 14, with the second piston 24 reaching its minimum volume at about 90 degrees crank angle after the first piston 14 reaches minimum volume. The first transfer valve 52 and the second transfer valve 54 are opened at the point where the second cylinder 22 reaches substantially minimum volume. This permits a transfer of a portion of the combustion gases from the first cylinder 12 to the second cylinder 22, and additional work energy is imparted to the second piston 24 due to the expansion of the combustion gases. Preferably, the second exhaust valve 28 is then opened for a short interval to cause an equalization of pressure between the first cylinder 12 and the second cylinder 22, and is then closed. At this point, the first intake valve 16 is opened to permit induction of intake air into the first cylinder 12. Since the volume of the second cylinder 22 is increasing and only the transfer valves 52 and 54 are opened, the second cylinder 22 extracts combustion gases from the first cylinder 12, which also aids in inducing the flow of intake air therein. Upon the completion of intake air induction into the first cylinder 12, the first intake valve 16, first transfer valve 52, and second transfer valve 54 are all closed to permit compression and combustion in the first cylinder 12. At the same time, the second exhaust valve 28 opened permit final exhaust of the combustion gases from the second cylinder 22 as the second piston 24 moves from its maximum volume to its minimum volume, when the second exhaust valve 28 is closed and the cycle is repeated. In this two-stroke operation, the first exhaust valve 18 and the second intake valve 26 are closed, with all intake and exhaust occurring through the first intake valve 16 and the second exhaust valve 28. During four-stroke operation, the transfer passage means 50 is not used, and the first and second transfer valves 52 and 54 remain inoperative. As is shown in FIG. 1, the transfer passage 50 permits a bi-directional flow between the selectively operable first and second transfer valves 52 and 54, and therefore the same steps alternatively apply to the operation of both the first and second cylinders 12 and 14, with the flow therebetween reversed.

Figure 2:
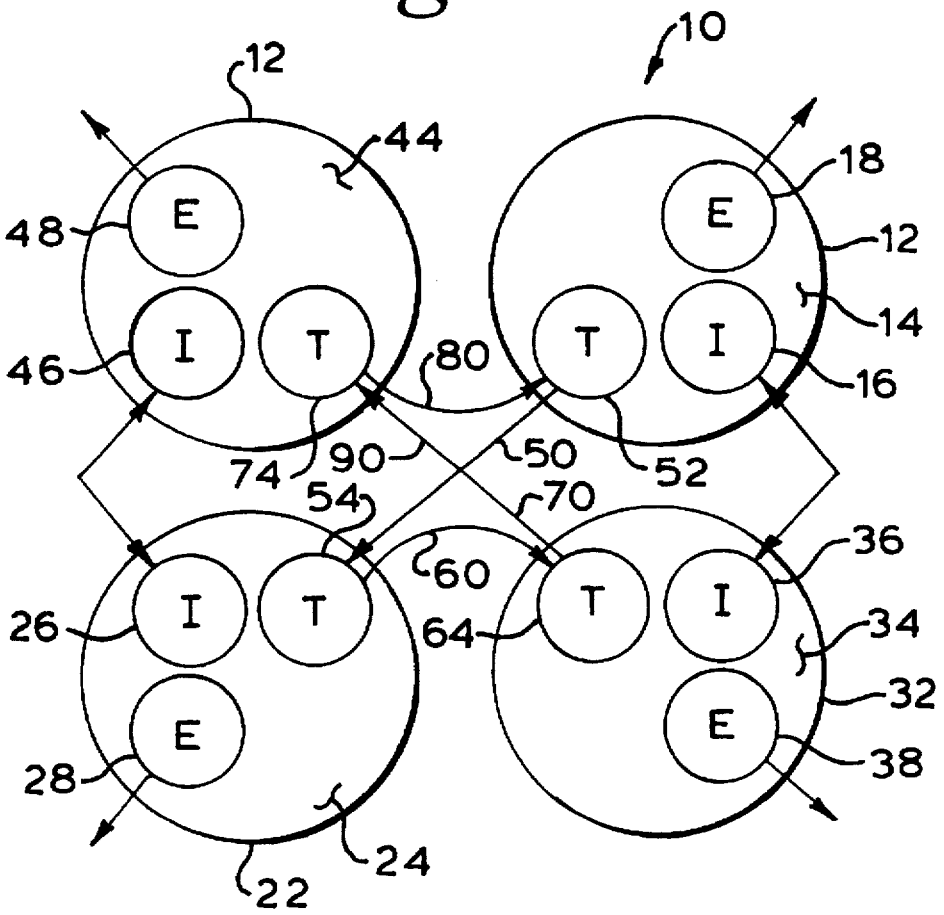
FIG. 2 shows a schematic representation of the valve and transfer passage means configuration suitable for use in a four cylinder engine configuration.
Figure 3:
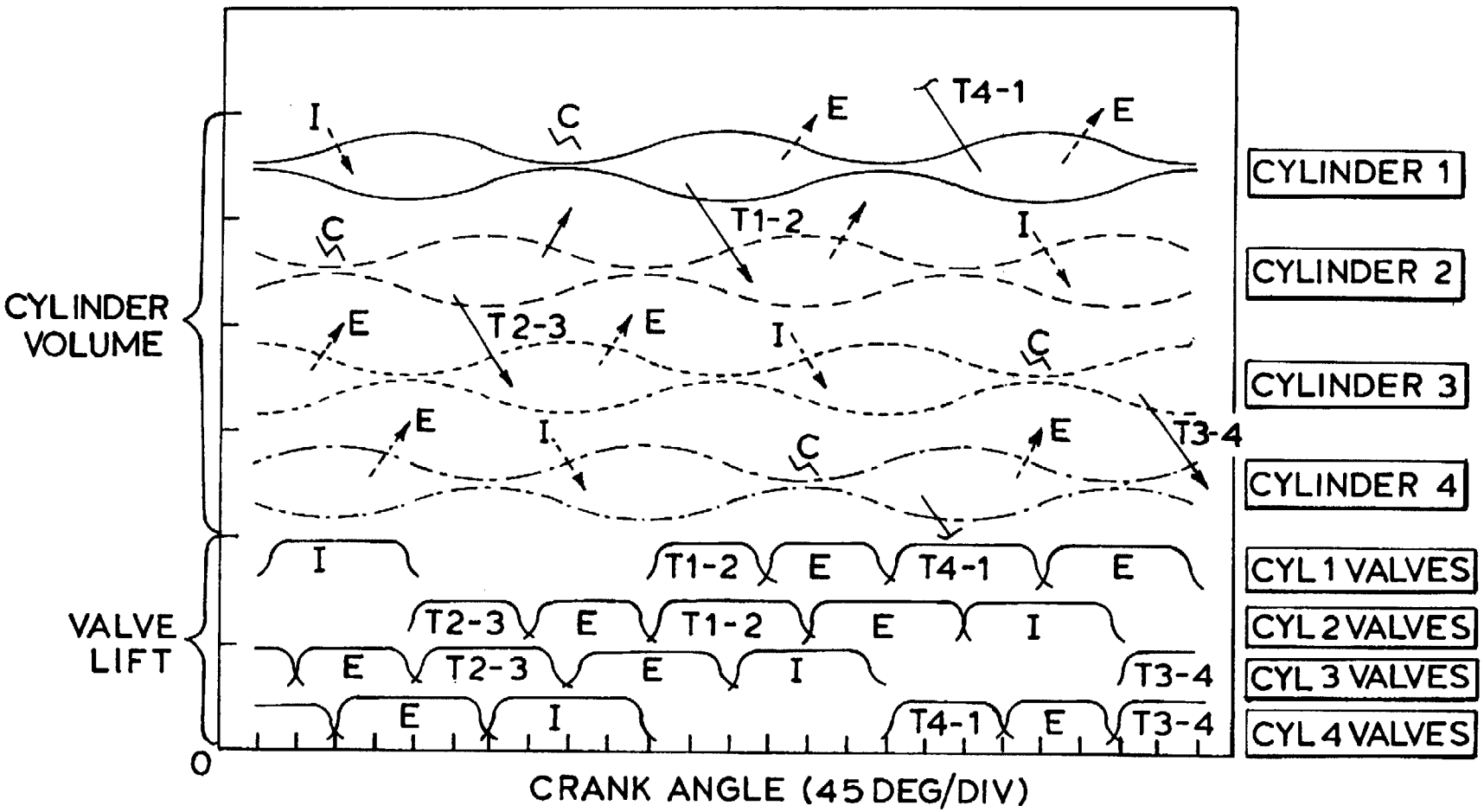
FIG. 3 is a diagrammatic representation of the valve operation of the configuration according to FIG. 2.

Turning then to FIGS. 2 and 3, the subject invention is disclosed as it may be employed in a four cylinder apparatus. FIG. 2, as in FIG. 1, schematically depicts the valve and transfer passage means configuration for an apparatus 10 capable of providing two-stroke, four-stroke, and six-stroke operation as selected according to load and efficiency demands.

As in FIG. 1, the apparatus 10 includes a first cylinder 12 in which a first piston 14 operates reciprocally. A first intake valve 16 is provided to permit induction of intake air into the first cylinder 12. A first exhaust valve 18 is provided to permit purging of exhaust gases from the first cylinder 12.

Again, the apparatus 10 further includes a second cylinder 22 in which a second piston 24 operates reciprocally is provided adjacent the first cylinder 12. A second intake valve 26 is provided to permit induction of intake air into the second cylinder 22, and a second exhaust valve 28 is provided to permit purging of exhaust gases from the second cylinder 22.

In addition, the apparatus 30 includes a third cylinder 32 in which a third piston 34 operates reciprocally. A third intake valve 36 is provided to permit induction of intake air into the third cylinder 32. A third exhaust valve 38 is provided to permit purging of exhaust gases from the third cylinder 32.

As the apparatus 10 in FIG. 2 is a four cylinder unit, the apparatus 10 includes a fourth cylinder 42 in which a fourth piston 44 operates reciprocally. A fourth intake valve 46 is provided to permit induction of intake air into the fourth cylinder 42. A fourth exhaust valve 48 is provided to permit purging of exhaust gases from the fourth cylinder 42.

A first transfer passage means 50 communicates between a first transfer valve 52 in the first cylinder 12 and a second transfer valve 54 in the second cylinder 22. A second transfer passage means 60 communicates between the second transfer valve 54 in the second cylinder 22 and a third transfer valve 64 in the third cylinder 32. A third transfer passage means 70 communicates between the third transfer valve 64 in the third cylinder 32 and a fourth transfer valve 74 in the fourth cylinder 42, and a fourth transfer passage means 80 communicates between the fourth transfer valve 74 in the fourth cylinder 42 and the first transfer valve 52 in the first cylinder 12.

According to the preferred embodiment, the respective transfer passage means 50, 60, 70, and 80 may be accomplished by the use of a manifold 90. The manifold 90 communicates between all the respective cylinders 12, 22, 32, and 42, and permits simpler construction and manufacture of the apparatus 10 than multiple separate and distinct passages would otherwise permit.

The selective operation of the apparatus 10 according to the preferred embodiment in four-stroke mode is accomplished according to the methodology previously disclosed and known in the prior art, of activating the intake valves and exhaust valves so as to accomplish the intake, compression, combustion and exhaust strokes in each cylinder. Likewise, the selective operation of the apparatus 10 in two-stroke mode is accomplished by activating the intake and exhaust valves to achieve the same functions in two piston strokes.

The selective operation of apparatus 10 in a six-stroke mode is disclosed more particularly in FIG. 3. FIG. 3 discloses the relative volume of each cylinder at various positions of crankshaft rotation, and shows the three complete crankshaft rotations necessary for six-stroke operation. In FIG. 3, C represents approximately the time of combustion, I represents intake, T represents transfer, and E represents exhaust. Each transfer passage means operation is represented by T followed by the cylinder number in which the transfer originates and the cylinder number in which the transfer terminates.

For purposes of this disclosure, the first piston 14, the second piston 24, the third piston 34 and the fourth piston 44 follow the preceding piston by 90 degrees. The first piston 14 is at Top Dead Center at 0 degrees, the second piston 24 is at Top Dead Center at 90 degrees, and so forth.

At 0 degrees, the first piston 14 is at Top Dead Center and minimum volume, and first intake valve 16 is opened to permit induction of intake air into the first cylinder 12. The first intake valve 16 remains open during approximately 180 degrees of crankshaft rotation, until the first piston has completed the intake stroke and the volume of the first cylinder 12 is at its maximum, at which time the first intake valve 16 closes. From 180 to 360 degrees, the first piston 14 compresses the intake air.

At 360 degrees, combustion occurs and the volume expands in the first cylinder 12 from 360 degrees to 540 degrees. However, at 450 degrees, the first transfer valve 52 and the second transfer valve 54 are opened (T1-2) to permit the expanding combustion gases to flow from the first cylinder 12 through the transfer passage means 50 to the second cylinder 22, which is at Top Dead Center. The first and second transfer valves 52 and 54 remain open until at least 540 degrees of rotation, and selectively up to 180 degrees thereafter in order to obtain full benefit of the combustion gas expansion. The expansion of combustion gases occurs in both the first cylinder 12 and the second cylinder 22.

The first exhaust valve 18 is opened from 585 degrees to 720 degrees to permit exhaust of the spent combustion gases, which is completed with the first piston 14 again at Top Dead Center. At this point, and continuing until at least 855 degrees the first transfer valve 52 is opened to receive combustion gases from the fourth cylinder 42 by way of the fourth transfer passage means 80, with the fourth transfer valve 74 being likewise open for flow of combustion gases from the fourth cylinder 42 (T4-1). Upon the completion of combustion gas expansion at 900 degrees, the first exhaust valve 18 is again opened until 1080 degrees to permit purging the spent combustion gases. At 1080 degrees (0 degrees), the six-stroke cycle is repeated.

Each of the cylinders 2, 3, and 4, follow this same cycle of operation, as shown in FIG. 3. To aid in the understanding of the cyclical nature of the engine according to the subject invention, FIG. 3 discloses the preferred relative timing of the transfers between the cylinders 2, 3, and 4 as well as those of cylinder 1, so that each of the respective cylinders can be operated in the six-cycle mode of operation. It will be noted in reviewing FIG. 3, for example, that expansion 1, 2, 3, or 4 during the greater part of the 1080 degree cycle, with only relatively short intervals between the expansion portions of the cycle, enhancing the overall efficiency of the engine.

As can be seen, the subject invention provides substantial advantages over the prior art in obtaining high efficiency, six-stroke operation, while retaining the benefits of two-stroke operation where high power output is desired over high efficiency. Furthermore, the apparatus 10 provides improved two-stroke operation, since the exhaust and scavenging of combustion gases from the first cylinder, and the induction of intake air is actively aided by the withdrawal of the combustion gases by the second cylinder. The apparatus 10 also retains the benefits of the balance of power output and efficiency available in four-stroke operation. Furthermore, such selective six-stroke operation may be obtained with relatively minor alteration in the design of the conventional reciprocating piston-type apparatus 10, requiring primarily the additional transfer valves and transfer passage means between the respective pistons. Additionally, since the transfer valves are selectively operable, the apparatus 10 may be normally operable as either two-stroke or four-stroke without detriment to the subject invention.

Modifications to the preferred embodiment of the subject invention will be apparent to those skilled in the art within the scope of the claims that follow:

I claim:

1. A method of selectively operating in two-stroke, four-stroke, or six-stroke operation of an internal combustion, reciprocating piston engine having a first cylinder in which a first piston reciprocally operates, the first cylinder further including a first intake valve, a first exhaust valve, and a first transfer valve; and a second cylinder in which a second piston reciprocally operates, the second cylinder further including a second intake valve, a second exhaust valve, and a second transfer valve, said method comprised of the steps of:

a) opening the first transfer valve as the first piston is substantially near Top Dead Center of a combustion stroke, wherein combustion gases are generated:

b) opening the second transfer valve at substantially the same time as the first transfer valve is opened;

c) permitting a portion of the combustion gases generated in the combustion stroke of the first piston to flow through said transfer passage means to said second piston;

d) permitting said portion of the combustion gases in said second piston to expand in said second cylinder to generate work energy;

e) closing said first transfer valve to prevent flow from said first cylinder at the completion of expansion in said first cylinder;

f) opening said first exhaust valve to permit exhaust of combustion gases from said first cylinder;

g) closing said second transfer valve at the completion of the expansion in said second cylinder;

h) opening said second exhaust valve at the completion of the expansion in said second cylinder to permit the exhaust of the combustion gases therefrom, and alternatively comprising the further steps of:

i) opening the second transfer valve as the second piston is substantially near Top Dead Center of a combustion stroke, wherein combustion gases are generated:

j) opening the first transfer valve at substantially the same time as the second transfer valve is opened;

k) permitting a portion of the combustion gases generated in the combustion stroke of the second piston to flow through said transfer passage means to said first piston;

l) permitting said portion of the combustion gases in said first piston to expand in said first cylinder to generate work energy;

m) closing said second transfer valve to prevent flow from said second cylinder at the completion of expansion in said first cylinder;

n) opening said second exhaust valve to permit exhaust of combustion gases from said second cylinder;

o) closing said first transfer valve at the completion of the expansion in said first cylinder; and p) opening said first exhaust valve at the completion of the expansion in said first cylinder to permit the exhaust of the combustion gases therefrom.

2. An internal combustion, reciprocating piston engine selectively capable of two-stroke, four-stroke, or six-stroke operation, said engine comprised of:

a first cylinder in which a first piston is reciprocally operable, said first cylinder further including a first intake valve, a first exhaust valve and a first transfer valve;

a second cylinder in which a second piston is reciprocally operable, said second cylinder further including a second intake valve, a second exhaust valve and a second transfer valve;

a third cylinder in which a third piston is reciprocally operable, said third cylinder further including a third intake valve, a third exhaust valve and a third transfer valve;

a fourth cylinder in which a fourth piston is reciprocally operable, said fourth cylinder further including a fourth intake valve, a fourth exhaust valve and a fourth transfer valve;

a first transfer passage means defined in said engine, said first transfer passage means connecting said first transfer valve and said second transfer valve for flow therebetween;

a second transfer passage means defined in said engine, said first transfer passage means connecting said first transfer valve and said second transfer valve for flow therebetween;

a third transfer passage means defined in said engine, said third transfer passage means connecting said third transfer valve and said fourth transfer valve for flow therebetween;

a fourth transfer passage means defined in said engine, said fourth transfer passage means connecting said fourth transfer valve and said first transfer valve for flow therebetween.

3. The internal combustion, reciprocating piston engine as set forth in claim 2 wherein said first transfer valve and said second transfer valve are selectively operable.

4. The internal combustion, reciprocating piston engine as set forth in claim 2 wherein said second transfer valve and said third transfer valve are selectively operable.

5. The internal combustion, reciprocating piston engine as set forth in claim 2 wherein said third transfer valve and said fourth transfer valve are selectively operable.

6. The internal combustion, reciprocating piston engine as set forth in claim 2 wherein said fourth transfer valve and said first transfer valve are selectively operable.

7. The internal combustion, reciprocating piston engine as set forth in claim 2 wherein said first transfer passage means, said second transfer passage means, said third transfer passage means, and said fourth transfer passage means are comprised of a manifold.

8. An internal combustion, reciprocating piston engine selectively capable of two-stroke, four-stroke, or six-stroke operation, said engine comprised of:

a first cylinder in which a first piston is reciprocally operable, said first cylinder further including a first intake valve, a first exhaust valve and a first transfer valve;

a second cylinder in which a second piston is reciprocally operable, said second cylinder further including a second intake valve, a second exhaust valve and a second transfer valve;

a third cylinder in which a third piston is reciprocally operable, said third cylinder further including a third intake valve, a third exhaust valve and a third transfer valve;

a fourth cylinder in which a fourth piston is reciprocally operable, said fourth cylinder further including a fourth intake valve, a fourth exhaust valve and a fourth transfer valve;

a first transfer passage means defined in said engine, said first transfer passage means connecting said first transfer valve and said second transfer valve for flow therebetween, said first transfer valve and said second transfer valve being selectively operable;

a second transfer passage means defined in said engine, said first transfer passage means connecting said first transfer valve and said second transfer valve for flow therebetween, said first transfer valve and said second transfer valve being selectively operable;

a third transfer passage means defined in said engine, said third transfer passage means connecting said third transfer valve and said fourth transfer valve for flow therebetween, said third transfer valve and said fourth transfer valve being selectively operable;

a fourth transfer passage means defined in said engine, said fourth transfer passage means connecting said fourth transfer valve and said first transfer valve for flow therebetween, said fourth transfer valve and said first transfer valve being selectively operable.

9. The engine as set forth in claim 8 wherein said first intake valve and said first exhaust valve are selectively operable to operate said first piston in a two-stroke, four-stroke, or six-stroke cycle.

10. The engine as set forth in claim 8 wherein said second intake valve and said second exhaust valve are selectively operable to operate said second piston in a two-stroke, four-stroke, or six-stroke cycle.

11. The engine as set forth in claim 8 wherein said third intake valve and said third exhaust valve are selectively operable to operate said third piston in a two-stroke, four-stroke, or six-stroke cycle.

12. The engine as set forth in claim 8 wherein said fourth intake valve and said fourth exhaust valve are selectively operable to operate said fourth piston in a two-stroke, four-stroke, or six-stroke cycle.

13. The internal combustion, reciprocating piston engine as set forth in claim 10 wherein said first transfer passage means, said second transfer passage means, said third transfer passage means, and said fourth transfer passage means are comprised of a manifold.

14. A method of operating an internal combustion, reciprocating piston engine having a first cylinder in which a first piston is reciprocally operable, said first cylinder further including a selectively operable first intake valve, a first selectively operable exhaust valve and a first transfer valve;

a second cylinder in which a second piston is reciprocally operable, said second cylinder further including a selectively operable second intake valve, a selectively operable second exhaust valve and a second transfer valve;

a third cylinder in which a third piston is reciprocally operable, said third cylinder further including a selectively operable third intake valve, a selectively operable third exhaust valve and a third transfer valve;

a fourth cylinder in which a fourth piston is reciprocally operable, said fourth cylinder further including a selectively operable fourth intake valve, a selectively operable fourth exhaust valve and a fourth transfer valve;

a first transfer passage means defined in said engine, said first transfer passage means connecting said first transfer valve and said second transfer valve for flow therebetween, said first transfer valve and said second transfer valve being selectively operable;

a second transfer passage means defined in said engine, said first transfer passage means connecting said first transfer valve and said second transfer valve for flow therebetween, said first transfer valve and said second transfer valve being selectively operable;

a third transfer passage means defined in said engine, said third transfer passage means connecting said third transfer valve and said fourth transfer valve for flow therebetween, said third transfer valve and said fourth transfer valve being selectively operable;

a fourth transfer passage means defined in said engine, said fourth transfer passage means connecting said fourth transfer valve and said first transfer valve for flow therebetween, said fourth transfer valve and said first transfer valve being selectively operable, said method comprising the steps of:

a) opening the first transfer valve as the first piston is substantially near Top Dead Center of a combustion stroke, wherein combustion gases are generated:

b) opening the second transfer valve at substantially the same time as the first transfer valve is opened;

c) permitting a portion of the combustion gases generated in the combustion stroke of the first piston to flow through said transfer passage means to said second piston;

d) permitting said portion of the combustion gases in said second piston to expand in said second cylinder to generate work energy;

e) closing said first transfer valve to prevent flow from said first cylinder at the completion of expansion in said first cylinder;

f) opening said first exhaust valve to permit exhaust of combustion gases from said first cylinder;

g) closing said second transfer valve at the completion of the expansion in said second cylinder; and h) opening said second exhaust valve at the completion of the expansion in said second cylinder to permit the exhaust of the combustion gases therefrom.

15. The method of operating an internal combustion, reciprocating piston engine as set forth in claim 14 including the further step of selectively operating said first intake valve and said first exhaust valve to operate said first cylinder in two-stroke cycle.

16. The method of operating an internal combustion, reciprocating piston engine as set forth in claim 15 including the further step of selectively operating said first intake valve and said first exhaust valve to operate said first cylinder in four-stroke cycle.

17. The method of operating an internal combustion, reciprocating piston engine as set forth in claim 16 including the further step of selectively operating said second intake valve and said second exhaust valve to operate said second cylinder in two-stroke cycle.

18. The method of operating an internal combustion, reciprocating piston engine as set forth in claim 16 including the further step of selectively said second intake valve and said second exhaust valve to operate said second cylinder in four-stroke cycle.

19. The method of operating an internal combustion, reciprocating piston engine as set forth in claim 14 including the further step of selectively operating said second intake valve and said second exhaust valve to operate said second cylinder in six-stroke cycle.

20. The method of operating an internal combustion, reciprocating piston engine as set forth in claim 19 including the further step of selectively operating said third intake valve and said third exhaust valve to operate said third cylinder in two-stroke cycle.

21. The method of operating an internal combustion, reciprocating piston engine as set forth in claim 20 including the further step of selectively operating said third intake valve and said third exhaust valve to operate said third cylinder in four-stroke cycle.

22. The method of operating an internal combustion, reciprocating piston engine as set forth in claim 21 including the further step of selectively operating said third intake valve and said third exhaust valve to operate said third cylinder in six-stroke cycle.

23. The method of operating an internal combustion, reciprocating piston engine as set forth in claim 19 including the further step of selectively operating said fourth intake valve and said fourth exhaust valve to operate said fourth cylinder in two-stroke cycle.

24. The method of operating an internal combustion, reciprocating piston engine as set forth in claim 23 including the further step of selectively operating said fourth intake valve and said fourth exhaust valve to operate said fourth cylinder in four-stroke cycle.

25. The method of operating an internal combustion, reciprocating piston engine as set forth in claim 24 including the further step of selectively operating said fourth intake valve and said fourth exhaust valve to operate said fourth cylinder in six-stroke cycle.

* * * * *